US005161575A

United States Patent [19]

Morikawa et al.

[11] Patent Number: 5,161,575

[45] Date of Patent: Nov. 10, 1992

[54] DIRECTION SELECTOR VALVE HAVING LOAD-SENSING FUNCTION

[75] Inventors: Rindo Morikawa; Kiyoshi Oyama, both of Saitama; Toichi Hirata, Tsuchiura; Yusuke Kajita, Tsuchiura; Genroku Sugiyama, Tsuchiura, all of Japan

[73] Assignees: ZEXEL Corporation; Hitachi Construction Machinery Co., Ltd., both of Tokyo, Japan

[21] Appl. No.: 717,537

[22] Filed: Jun. 19, 1991

[30] Foreign Application Priority Data

Jun. 22, 1990 [JP] Japan ..... 2-162771
May 30, 1991 [JP] Japan ..... 3-153679

[51] Int. Cl.[5] ..... F15B 13/08

[52] U.S. Cl. ..... 137/596.13; 91/446; 91/518; 137/596; 137/625.68

[58] Field of Search ..... 91/446, 518; 137/596, 137/596.13, 625.68

[56] References Cited

U.S. PATENT DOCUMENTS 3,707,988 1/1973 Hodgson ..... 137/596.12
5,025,625 6/1991 Morikawa ..... 137/596.13 X
5,038,671 8/1991 Ueno ..... 137/596.13 X

FOREIGN PATENT DOCUMENTS 1-150201 10/1989 Japan .
1-266302 10/1989 Japan .
2-134402 5/1990 Japan .

*Primary Examiner*—Gerald A. Michalsky
*Attorney, Agent, or Firm*—Nields & Lemack

[57] ABSTRACT

There is disclosed a direction selector valve having function of detecting load. The valve is used in a hydraulic system. A spool has two passage holes extending axially partially through the spool from both side ends. These two passage holes have their respective high-pressure holes. When the spool is in its neutral position, the high-pressure holes are closed off by spool hole walls between bridge ports and actuator ports. The two passage holes further include low-pressure holes which are in communication with tank ports via load check valves mounted in the passage holes, respectively. Guide holes are formed near the front end of one passage hole and in communication with a load-sensing port. A restriction portion is formed on the outer surface of the spool adjacently to the guide holes to control the flow from the load-sensing port to the tank ports. First guide holes and second guide holes which are close to each other are formed near the front end of the other passage hole. The first guide holes are in communication with the load-sensing port even when the spool is in its neutral position. The second guide holes are placed in communication with the load-sensing port after the spool has shifted from its neutral position, connecting the high-pressure holes with the bridge ports. This structure smoothly responds to the load pressure in the actuator.

12 Claims, 6 Drawing Sheets

DIRECTION SELECTOR VALVE HAVING LOAD-SENSING FUNCTION

FIELD OF THE INVENTION

The present invention relates to a direction selector valve and, more particularly, to a direction selector valve having load-sensing function.

BACKGROUND OF THE INVENTION

In building machines typified by power shovels and backhoes, the oil delivered from one hydraulic pump sometimes actuates plural actuators, such as motors for swing motion, left and right motors for travel motion, boom cylinders, arm cylinders, and bucket cylinders.

These actuators are connected with a hydraulic pump via their respective direction selector valves. The operation of the actuators is controlled by operating the direction selector valves separately. It is customary to regulate the flow rate of oil flowing into the actuators by pressure-compensating valves to prevent the working speeds of the actuators from changing if the load varies.

In the above-described building machines; plural actuators are often operated simultaneously. For example, a boom cylinder, an arm cylinder, and a bucket cylinder are driven at the same time. In this case, if the total oil flow rate required by the actuators working simultaneously is extremely large, then the capability of the hydraulic pump to deliver oil becomes insufficient, thus leading to a reduction in the supplied pressure. Then, the pressure-compensating valves fail to function normally. As a result, only the actuator on the side of the lighter load is driven; the actuator on the side of the higher load is not driven. The balance of working speed between the actuators is lost.

Techniques for alleviating these problems are disclosed in Japanese Utility Model Laid-Open No. 150201/1989, Japanese Patent Laid-Open Nos. 266302/1989 and 134402/1990. In these techniques, a shuttle valve is incorporated in each direction selector valve in addition to a pressure-compensating valve. Thus, a composite valve is formed. The pressure applied to each actuator by the load is detected and guided to both pressure-compensating valve and shuttle valve. Such composite valves are assembled into a unit to form a multiple valve. The greatest of the load pressures to the presently operating actuators is selected by the shuttle valve. The pump line pressure, or the pressure in the whole circuit, is adjusted by the selected greatest load pressure. The opening of the throttle of the pressure-compensating valve is controlled according to the difference between the greatest load pressure and the pump line pressure.

In the prior art techniques, the spool of the direction selector valve is equipped with a known throttling rod for switching the present set of actuator port and bridge port to the other set of actuator port and bridge port and for controlling the flow rate of the supplied pressure oil. In order to detect the load pressure in the actuator, the spool is provided with a hole forming a passage.

Specifically, a load-sensing port is formed in the center of the spool hole in the direction selector valve. The pressure-receiving surfaces of the pressure-compensating valve and of the shuttle valve face this load-sensing port. Dead-end load-sensing holes extend axially partially through the spool from its both side ends. Each load-sensing hole contains a land portion near its front end. When the spool is in its neutral position, the load-sensing port faces these land portions. Radially extending guide holes are formed in the land portions. The guide holes are called central guide holes. The load-sensing hole contains second land portions which are located between the actuator ports and their respective tank ports when the spool is in its neutral position. Other radially extending guide holes, called side guide holes, are formed in the second land portions.

In these prior art techniques, when the spool of the direction selector valve is in its neutral position, both central guide holes are located in the load-sensing port, and the side guide holes are placed in the tank ports. Thus, the load-sensing port is placed in communication with the tank ports. When the spool has shifted, the actuator ports are connected with the load-sensing port via the central guide holes and the side guide holes in the left or right load-sensing hole, depending on the direction of the shift. The load pressure to the actuator is made to act on the pressure-compensating valve in the direction to open it. At the same time, the pressure is sent to the shuttle valve.

These prior art techniques have the following disadvantages. When the spool of the direction selector valve begins to shift from its neutral position, the side guide holes contained in the load-sensing holes into which the load pressure is to be introduced are disconnected from the tank ports. Then, the central guide hole into which the load pressure is not admitted is disconnected from the load-sensing port. Under this condition, the load-sensing port is in communication with none of the tank ports. Thereafter, the side guide holes contained in the load-sensing hole into which the load pressure is to be introduced are placed in communication with the actuator ports before the throttling land portions start to permit the actuator ports to be connected with the bridge ports.

The relation of the area of the opening to the stroke of the spool is shown in FIG. 8. In particular, as soon as the stroke of the spool begins, the area of the opening permitting the fluid to flow from the load-sensing port LS to the tank ports T decreases down to zero. Then, the area of the opening permitting the fluid to pass from the actuator port B to the load-sensing port LS increases rapidly.

In the prior art techniques, therefore, when the spool reaches a certain point of stroke, the load pressure rushes into the load-sensing port, increasing the pressure inside this port rapidly. In this way, the pump line pressure rises steeply as shown in FIG. 9. This has posed problems.

Specifically, since the load-sensing port is also in communication with the entrances to the shuttle valve, the load pressure acts into the first entrance to the shuttle valve. At the same time, the load pressure from the other direction selector valve acts into the second entrance to the shuttle valve. The higher pressure is selected and delivered from the exit. Because this exit is in communication with the entrance to the shuttle valve of the next direction selector valve, it follows that the greatest load pressure is taken from the exit of the final-stage shuttle valve. This greatest load pressure is directed to an unloading pressure control valve connected with the pump delivery passage on the upstream side of the pressure-compensating valve.

When the spool of the direction selector valve is in its neutral position, the pressure inside the load-sensing port is not increased. Of course, the pressure inside the back pressure chamber in the unloading pressure control valve is low. The valve body of the unloading pressure control valve is opened. The oil delivered from the pump is returned to the tank under unloaded condition. When the spool of the direction selector valve shifts, the load pressure is detected to close the valve body of the unloading pressure control valve. This stops the oil delivered from the pump from being returned to the tank. The result is that the pump line pressure, or the circuit pressure, rises.

When the spool reaches a certain point of its stroke, all the load pressure pours into the load-sensing port via either load-sensing hole as mentioned above. This means that the greatest load pressure selected by the shuttle valve suddenly acts into the back pressure chamber in the unloading pressure control valve, closing the valve body of the unloading pressure control valve suddenly. As shown in FIG. 9, therefore, the pump line pressure increases at a high rate. The working oil under this increased pressure is forced into the actuator through the pressure-compensating valve, the bridge port, and the actuator port.

As a result, when the actuator of the prior art direction selector valve having load-sensing function is started to be actuated such as when travel motion is initiated or when the boom is started to be elevated, a large shock is produced, or large noise is created due to surging pressure. Another problem is that when the pressure in the actuator is increased gradually to lift the load slowly, it is difficult to control the pressure.

SUMMARY OF THE INVENTION

It is an object of the present invention to provide a direction selector valve which has a load-sensing function, is free of the foregoing problems, is relatively simple in structure but capable of responding to load pressure smoothly, and can gradually increase the pump line pressure.

The above object is achieved by a direction selector valve comprising a spool, actuator ports, a load-sensing port, tank ports, and bridge ports, the spool having passages constructed in such a way that the actuator ports can be connected and disconnected with the load-sensing port and that the load-sensing port can be connected and disconnected with the tank ports. The passage structure of the spool is also used to control the flow rate of the pump pressure oil flowing from the bridge ports to the actuator ports.

The novel selector valve comprises a valve body having a spool hole, said spool slidably inserted in the spool hole, said load-sensing port formed around the center of the spool hole, said bridge ports formed on opposite sides of the load-sensing port around the spool hole, said actuator ports formed on opposite sides of the load-sensing port around the spool hole, and said tank ports formed on opposite sides of the load-sensing port around the spool hole.

The spool has two dead-end passage holes extending axially partially through the spool from both of its side ends. These two passage holes have radially extending high-pressure holes and radially extending low-pressure holes. When the spool is in its neutral position, the high-pressure holes are closed off by spool hole walls between the bridge ports and their respective actuator ports. Also when the spool is in its neutral position, the low-pressure holes are in communication with the tank ports. The low-pressure holes are opened and closed by load check valves mounted in the passage holes, respectively.

Guide holes are formed near the front end of one of the passage holes and placed in communication with the load-sensing port when the spool is in its neutral position. A restriction portion is formed on the outer surface of the spool adjacently to the guide holes to control the flow from the load-sensing port to the tank ports at the initial stage of the movement of the spool.

First guide holes and second guide holes are formed around the front end of the other passage hole in a close relation to each other. The first guide holes are in communication with the load-sensing port even when the spool is in its neutral position. When the spool is in its neutrall position, the second guide holes are closed off by spool hole walls. The second guide holes are placed in communication with the load-sensing port after the spool has shifted from its neutral position, connecting the high-pressure holes with the bridge ports.

Preferably, the diameter of the first-mentioned guide holes is larger than that of the first guide holes. The diameter of the first guide holes is larger than that of the second guide holes.

Other objects, features, and many of the attendant advantages of the invention will become apparent in the following description. It is to be understood that various changes and modifications may be made to the construction of the illustrated embodiments within the scope of the appended claims.

DETAILED DESCRIPTION OF THE PREFERRED EMBODIMENTS

Figure 1:
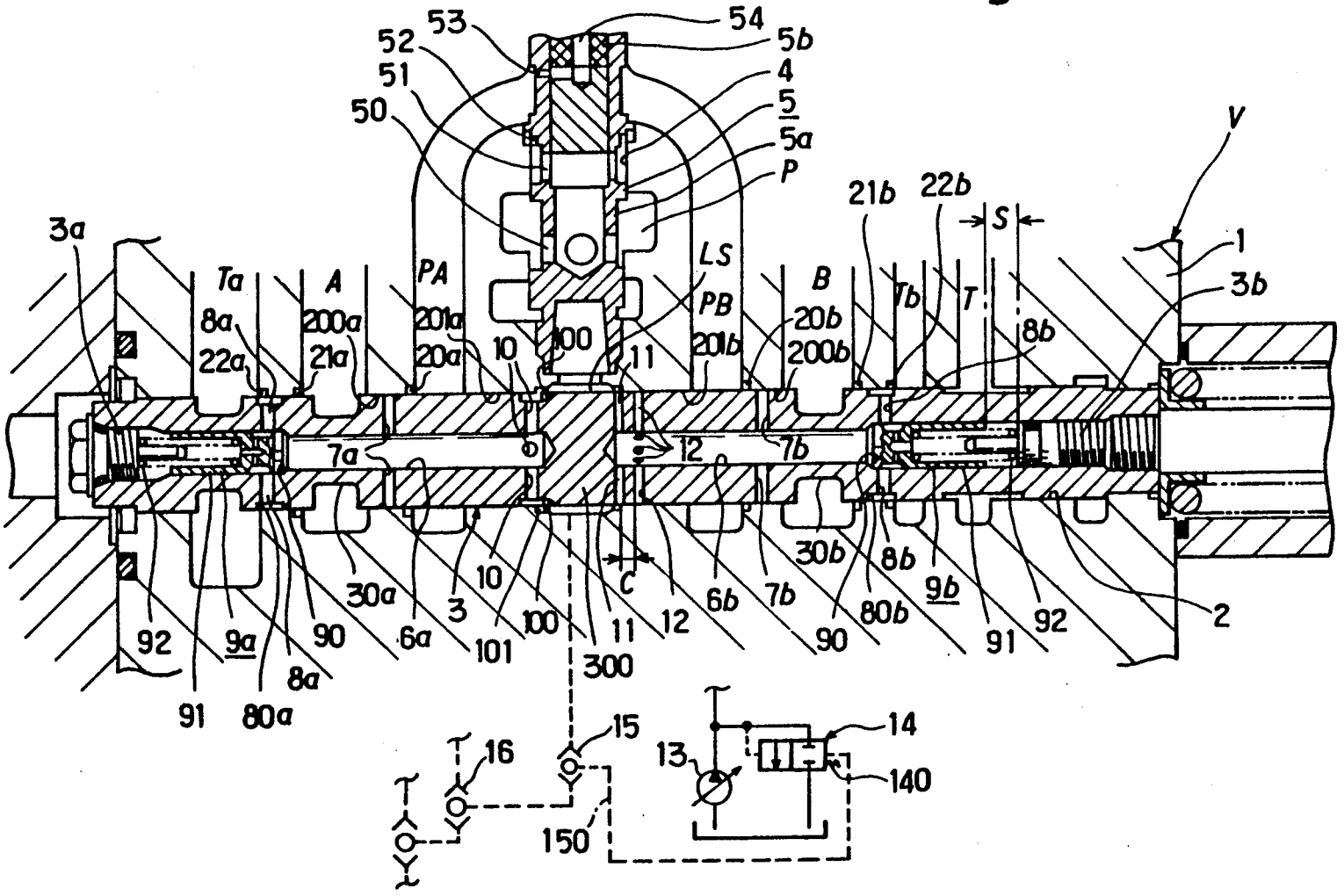
FIG. 1 is a cross-sectional view of a direction selector valve according to the invention, and in which the spool is in its neutral position.
Figure 2:
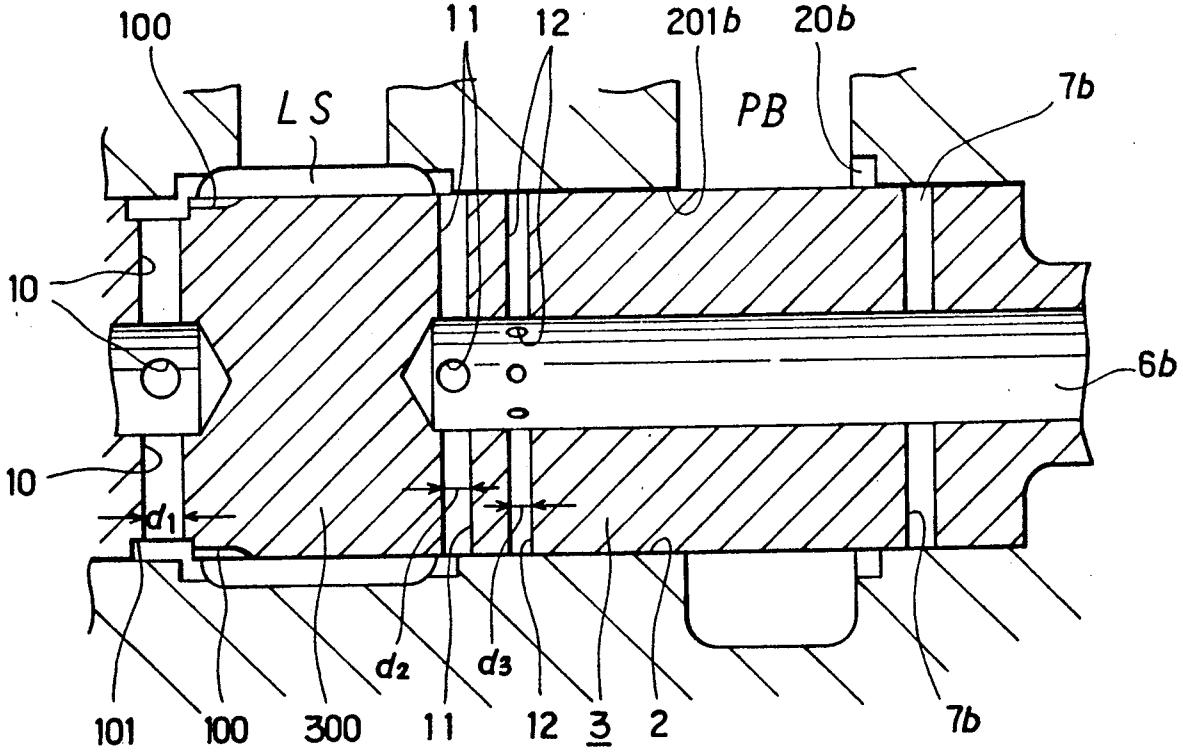
FIG. 2 is an enlarged cross section of a part of the valve shown in FIG. 1.
Figure 3:
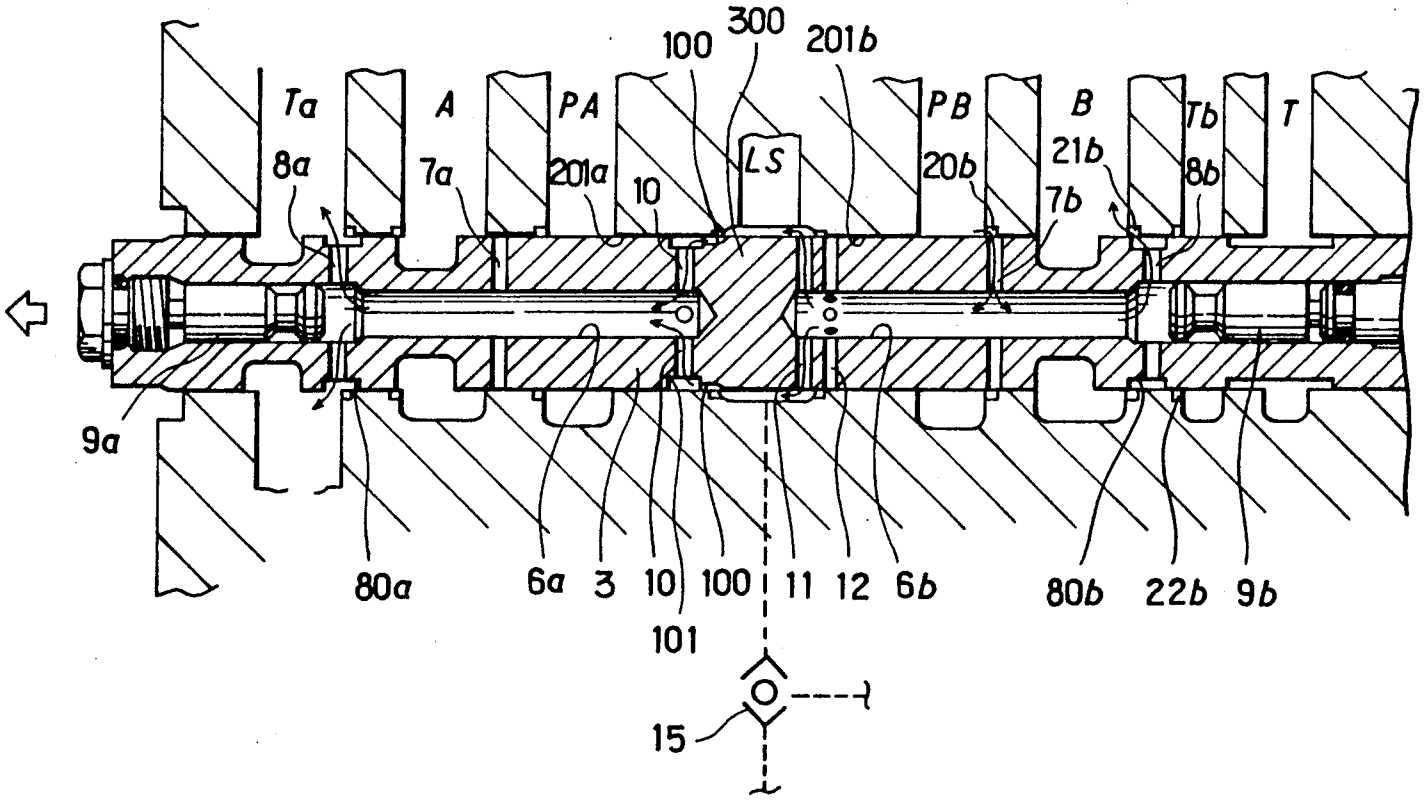
FIG. 3 is a cross-sectional view of the valve shown in FIG. 1, for showing the condition in which the spool is moving.
Figure 4:
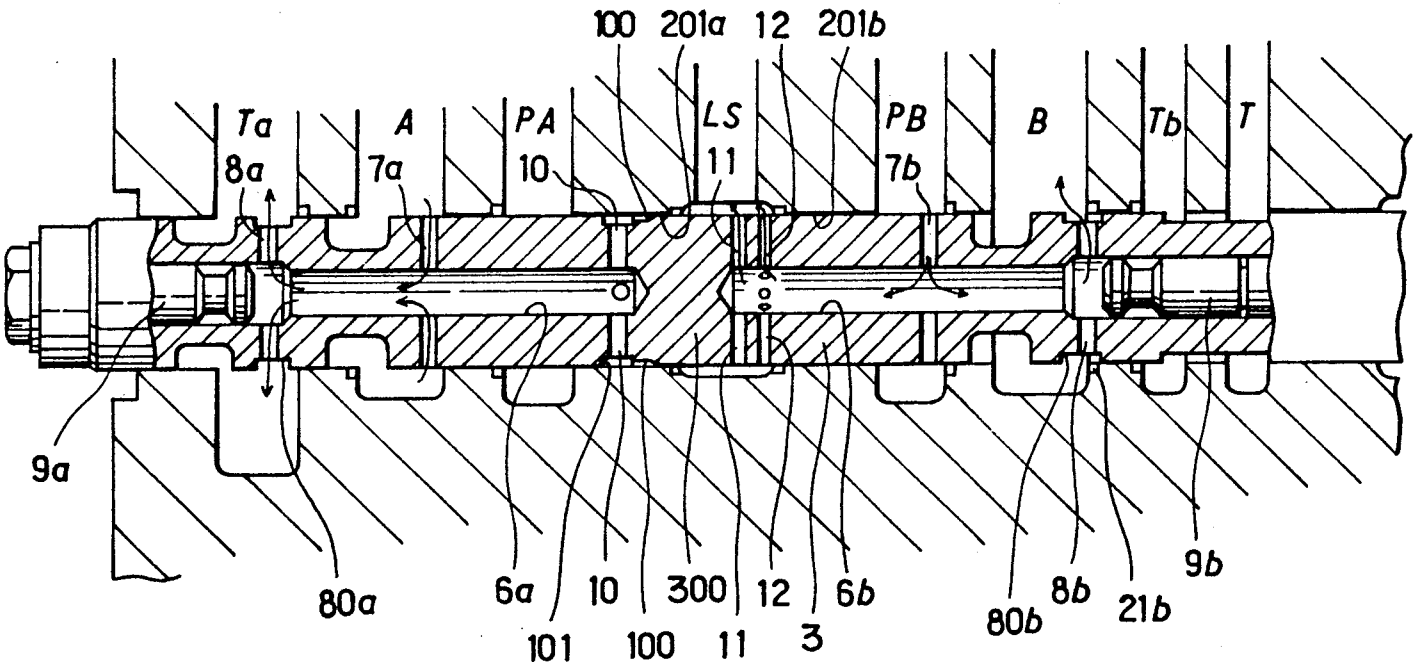
FIG. 4 is a view similar to FIG. 3, but showing the condition in which the spool is at full stroke.
Figure 5:
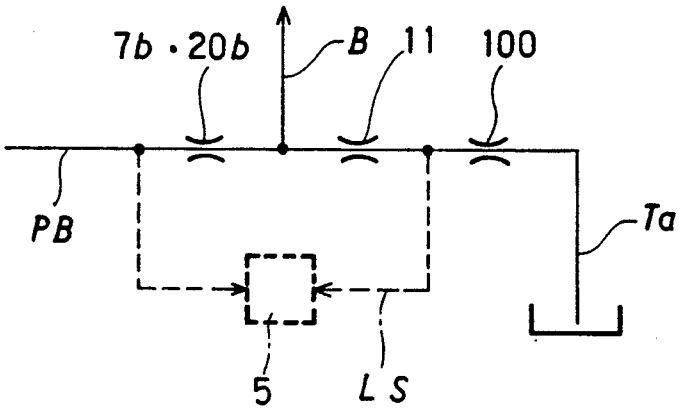
FIG. 5 is a diagram of a circuit including a direction selector valve according to the invention.

Referring to FIGS. 1, 2, 3, and 4, there is shown a direction selector valve embodying the concept of the invention. In the condition of FIGS. 1 and 2, the spool of the valve is in its neutral position. In the conditions of FIGS. 3 and 4, the spool has shifted from its neutral position. The direction selector valve is generally indicated by V. This valve and other direction selector valves of the same structure form a multiple valve. The valve V comprises a valve body 1, spool hole 2 extending horizontally through the valve body, and the spool, indicated by numeral 3. This spool 3 is slidably inserted in the spool hole 2.

An external pump 13 is connected with a pump port P via pipe lines and passage (not shown), the pump port being formed in the valve body 1 mounted above the center of the spool hole 2. An unloading pressure control valve 14 is connected between the discharge opening of the pump 13 and the pump port P. The greatest actuator load pressure selected by the shuttle valve is introduced into the back pressure chamber in the unloading pressure control valve 14 in the conventional manner. The pressure delivered from the pump is adjusted according to the resultant of this greatest load pressure and the load applied by the spring 140 to create pump line pressure.

The spool hole 2 has an annular load-sensing port LS in its center. Bridge ports PA and PB into which pressure oil from the pump 13 is supplied are formed on opposite sides of the load-sensing port LS. The upper ends of the the bridge ports PA and PB are in communication with a vertical hole 4 extending perpendicular to the spool hole 2. The oil forced out of the pump is supplied into the bridge ports PA and PB through the pump port P and a pressure-compensating valve 5 in the vertical hole 4.

The pressure-receiving surface of the pressure-compensating valve 5 is in communication with the load-sensing port LS and opened by the load pressure admitted into this port LS. This port LS is in communication with a shuttle valve 15 mounted in the valve body 1. This valve 15 has a first entrance, a second entrance, an exit, and a ball. This ball is mounted among these entrances and exit in the same way as in the conventional valve. The first entrance to the shuttle valve 15 is in communication with the load-sensing port LS, while the second entrance is in communication with the exit of the shuttle valve of the adjacent direction selector valve 16.

The pressure-compensating valve 5 may be of the conventional spring type but is preferably so constructed that it is controlled by the difference between the pump line pressure and the actuator load pressure, as disclosed in the above-cited references. FIG. 1 partially shows the pressure-compensating valve 5 of the latter construction. A cylindrical spool 5*a* is slidably fitted in the vertical hole 4. A sleeve 5*b* is screwed into the spool 5*a*.

The pump port P opens into the vertical hole 4 above the spool hole 2. The cylindrical spool 5*a* is provided with a hole 50 extending through it. This spool 5*a* is located at a position corresponding to the pump port P. The spool 5*a* has a land portion fitted in the vertical hole 4, as well as a rod portion adjacent to the land portion. A hole 51 extends through the rod portion. A notch 52 is formed in the outer surface of the spool 5*a* at the position at which the vertical hole 4 intersects with the upper ends of the bridge ports PA and PB. The notch 52 controls the flow rate of the oil passing into the hole 51 from the pump port P before the oil flows into the bridge ports PA and PB.

A signal pressure introduction hole 53 for introducing the pressures from the bridge ports PA and PB is formed in the outer surface of the cylindrical spool which faces the region where the bridge ports PA and PB are interconnected. A passage 54 is formed in a sleeve 5*b* to direct the signal pressure upward, the signal pressure being introduced into the valve from the introduction port 53. The passage 54 extends to the pressure-receiving surface (not shown) at the upper end of the sleeve 5*b*. Pressure acting on this pressure-receiving surface pushes the cylindrical spool 5*a* in such a direction as to close the valve.

Actuator ports A and B are formed outside the bridge ports PA and PB and extend to the upper end surface of the valve body 1. These actuator ports A and B are connected with the side having the piston and with the side having the rod of an actuator (not shown) such as a hydraulic cylinder. A left tank port Ta and a right tank port Tb are formed outside the actuator ports A and B, respectively, and connected with a tank (not shown).

First annular restriction portions 20*a* and 20*b* are formed at relatively outer locations in the bridge ports PA and PB, respectively. Similarly, second annular restriction portions 21*a* and 21*b* are formed at relatively outer locations in the actuator ports A and B, respectively. Third annular restriction portions 22*a* and 22*b* are formed at relatively inner locations in the tank ports Ta and Tb, respectively.

The spool 3 extends through the valve body 1. The right end (as viewed in the figure) of the spool is supported by a returning spring mechanism. An arbitrary operating means acts on the left end of the spool. In this example, the left end faces on the pilot pressure chamber. Hydraulic pilot pressure introduced into this chamber pushes against the left end. Rod portions 30*a* and 30*b* are mounted on the outer surface of the spool 3 and received in the actuator ports A and B, respectively. These rod portions 30*a* and 30*b* are not essential to the present invention.

Passage holes 6*a* and 6*b* extend axially through the spool 3 from the left end and the right end, respectively. The holes 6*a* and 6*b* will be hereinafter referred to as the first and second passage holes, respectively, if necessary. The first passage hole 6*a* and the second passage hole 6*b* are located on the same axis. The front ends of these holes 6*a* and 6*b* are located in a spool central portion 300 inside the load-sensing port described above. That is, the passage holes 6*a* and 6*b* terminate in these locations. The rear ends of the first passage hole 6*a* and the second passage hole 6*b* are closed off by plugs 3*a* and 3*b*, respectively, screwed into the left end and the right end, respectively.

The spool 3 is provided with radially extending high-pressure holes 7*a* and 7*b* in the land portions close to the rod portions 30*a* and 30*b*, respectively. These holes 7*a* and 7*b* are in communication with the passage holes 6*a* and 6*b*, respectively. The high-pressure holes 7*a* are circumferentially spaced from each other. Likewise, the high-pressure holes 7*b* are circumferentially spaced from each other. When the spool 3 is in its neutral position, the opening is closed by spool hole walls 200*a* and 200*b* between the bridge ports PA, PB and the actuator ports A, B. When the spool has moved from its neutral position, a restricted passage is formed by the first annual restriction portions 20*a* and 20*b*.

The spool 3 is also provided with radially extending low-pressure holes 8*a* and 8*b* in the land portions which are on the opposite sides of the rod portions 30*a* and 30*b*, respectively, from the high-pressure holes 7*a* and 7*b* , respectively. These low-pressure holes 8*a* aand 8*b* are in communication with the passage holes 6*a* and 6*b*, respectively. The radially outer ends of the low-pressure holes 8*a* and 8*b* are in communication with ring-shaped grooves 80*a* and 80*b*, respectively, formed in the outer surface of the spool. When the spool is in its neutral position, the grooves 80*a* and 80*b* are in communication with the third annular restriction portions 22*a* and 22*b*, respectively, which face the tank ports Ta and Tb, respectively.

Normally, the low-pressure hole 8*a* is disconnected from the first passage hole 6*a* by a load check valve 9*a*. Similarly, the low-pressure hole 8*b* is disconnected from the second passage hole 6*b* by a load check valve 9*b*. The load check valves 9*a* and 9*b* are opened when oil is forced into them from the front ends of the passage holes 6*a* and 6*b* , respectively. The check valves 9*a* and 9*b* can have any arbitrary structure. In this example, each of the load check valves 9*a* and 9*b* has a poppet valve body 91 slidably fitted in the wall forming the passage hole. The poppet valve bodies 91 of the check valves are biased from the rear side by springs 92 held by the plugs 3*a* and 3*b* described above. In this way, the front ends of the valve bodies are seated on seat portions 90 formed at the boundaries between the inner ends of the low-pressure holes 8*a*, 8*b* and the passage holes 6*a*, 6*b*.

The spool 3 is further formed with radially extending guide holes 10 formed in close proximity to the central portion 300 of the spool. The guide holes 10 are in communication with the front end of the first passage hole 6*a* shown at the left. The guide holes 10 are circumferentially spaced from each other. In the illustrated example, the guide holes 10 are four in number. The guide holes 10 are in communication with a ring-shaped groove 101 formed in the outer surface of the spool. When the spool is in its neutral position, the groove 101 is placed in communication with the load-sensing port LS. When the spool 3 has shifted to the left, the groove 101 is closed by a spool hole wall 201*a*.

A restriction portion 100 is formed on the outer surface of the spool central portion 300 adjacent to the ring-shaped groove 101. At the initial stage of the movement of the spool 3, the restriction portion 100 restricts the flow rate of the pressure oil flowing from the load-sensing port LS to the tank port Ta. This restricting action occurs when the low-pressure hole 8*b* into which the pump pressure oil is to be supplied is disconnected from the tank port Tb. This action persists when the actuator ports are connected with the load-sensing port LS and even when the bridge port PB is connected with the actuator port B. The restriction portion 100 may taper off. Preferably, however, the restriction portion 100 consists of a plurality of notches circumferentially spaced from each other as in the illustrated example. The axial ends of the notches are in communication with the ring-shaped groove 101.

First guide holes 11 are formed in close proximity to the central portion 300 of the spool on the opposite side of the aforementioned guide holes 10. The inner ends of the first guide holes 11 are in communication with the front end of the second passage hole 6*b* shown at the right. The first guide holes 11 are arranged on the same circumference. In the illustrated example, the first guide holes 11 are two in number. These first guide holes 11 are in communication with the load-sensing port LS even when the sppol 3 is in its neutral position.

When the bridge port PB is connected with the actuator port B, the first guide holes 11 introduce the pressure oil from the actuator port B into the load-sensing port LS. This introduction is referred to as the primary introduction herein. When the bridge port PA is connected with the actuator port A, the first guide holes 11 serve to restrict the flow rate of the pressure oil flowing from the load-sensing port LS to the tank port Tb. Therefore, as shown in FIG. 2, the diameter $d_2$ of the first guide holes 11 is smaller than the diameter $d_1$ of the guide holes 10.

Second guide holes 12 are spaced from the first guide holes 11 by a given distance C. The inner ends of the second guide holes 12 are in communication with the second passage hole 6*b*. The second guide holes 12 are circumferentially spaced from each other. In the illustrated example, the second guide holes 12 are 8 in number. The outer ends of the second guide holes 12 are closed by a spool hole wall 201*b* between the load-sensing port LS and the bridge port PB when the spool 3 is in its neutral position. When the bridge port PB is connected with the actuator port B, the second guide holes 12 introduce the load pressure from the acutator port B into the load-sensing port LS. This introduction is referred to as the secondary introduction herein. The diameter $d_3$ of the second guide holes 12 is set less than the diameter $d_2$ of the first guide holes 11.

In this example, the first guide holes 11 and the second guide holes 12 are formed in the second passage hole 6*b* corresponding to the right actuator port B. These guide holes 11 and 12 can also be formed in the first passage hole 6*a* corresponding to the left actuator port A. In this case, of course, the guide holes 10 and the restriction portion 100 are formed at the right of the central portion of the spool.

Where the direction selector valve V and other similar direction selector valves are stacked valves, they are stacked according to the number of the actuators. The operation of the structure constructed described thus far is described next.

The pressure oil discharged from the pump 13 flows in the manner described now. The pressure oil passes through the pipe lines and passages and enters the pump port P of each direction selector valve. The oil then enters the valve from the hole 50 extending through the cylindrical spool 5*a* of the pressure compensating valve 5, and passes into the bridge ports PA and PB through the hole 51 and the notch 52.

When the spool 3 is in its neutral position as shown in FIG. 1, the left high pressure hole 7*a* and the right high-pressure hole 7*b* are closed off by spool hole wall 200*a*, and 200*b*, respectively. In this state, since the ring-shaped grooves 80*a* and 80*b* are in communication with the third annular grooves 22*a* and 22*b*, respectively, the left low-pressure hole 8*a* and the right low-pressure hole 8*b* are in communication with the left tank port Ta and the right tank port Tb, respectively. The guide holes 10 and the first guide holes 11 which are adjacent to the central portion 300 of the spool are in communication with the load-sensing port LS.

The oil inside the load-sensing port LS flows through the first passage hole 6*a* and the second passage hole 6*b* from the guide holes 10 and the first guide holes 11, respectively. Then, the oil acts on the load check valves 9*a* and 9*b* whose pressure-receiving surfaces face the first passage hole 6*a* and the second passage hole 6*b*, respectively, to open the check valves 9*a* and 9*b*, respectively. The oil inside the load-sensing port LS is forced out of the low-pressure holes 8*a* and 8*b* into the tank ports Ta and Tb, respectively. The check valves 9*a* and 9*b* are closed when the pressure inside the load-sensing port LS becomes substantially equal to the pressure inside the tank ports.

When the spool 3 is in its neutral position, the load pressure inside the load-sensing port LS is not increased. Hence the load pressure that is nearly null passes into the back pressure chamber in the unloading pressure control valve 14 through the shuttle valve 15 in communication with the load-sensing port LS. The pressure discharged from the pump is guided as pilot pressure into the chamber opposing the back pressure chamber inside the unloading pressure control valve 14. If the pressure discharged from the pump is in excess of the load applied by the spring 140, the excessive pressure portion opens the valve body of the unloading pressure control valve from the condition shown in FIG. 1. The oil is then returned into the tank.

Under this condition, if the spool 3 is shifted to the left as viewed in FIG. 1 to supply the pressure oil from the pump into the right actuator pump B, then the ring-shaped groove 80*b* located at the outer end of the low-pressure hole 8*b* contained in the second passage hole 6*b* begins to be disconnected from the tank port Tb. Also, the high-pressure hole 7*b* in the second passage hole 6*b* gradually approaches the bridge port PB. At the same time, the second guide holes 12 come close to the load-sensing port LS.

Meanwhile, the guide holes 10 in the first passage hole 6*a* move to the left. The restriction portion 100 adjacent to the guide holes 10 approaches the starting end of the spool hole wall 201*a* next to the left end of the load-sensing port LS. The restriction portion 100 begins to restrict the flow rate. The low-pressure hole 8*b* in the second passage hole 6*b* is disconnected from the tank port Tb. This prevents the oil in the oil in the load-sensing port LS from being discharged to the right from the second passage hole 6*b*. However, the guide holes 10 remain in communication with the load-sensing port LS via the restriction portion 100. Therefore, the load-sensing port LS and the second passage hole 6*b* are kept in communication with the tank port Ta on the inside of the first passage hole 6*a* during the initial stage of the stroke of the spool.

This initial stage is similar to the initial stage of the prior art process. That is, the low-pressure hole 8*b* contained in the passage hole 6*b* into which the load pressure is to be introduced is disconnected from the tank port. At the next stage, the guide holes 10 contained in the passage hole 6*a* into which the load pressure is not introduced is prevented from being disconnected from the load-sensing port LS during an arbitrarily set stage of the stroke of the spool, is being noted that the guide holes 10 correspond to the central guide holes in the prior art valve. Under this condition, the actuator port B is connected with the load-sensing port LS. Then, the bridge port PB is connected with the actuator port B.

As the stroke of the spool 3 increases, the ring-shaped groove 80*b* in the low-pressure hole 8*b* contained in the second passage hole 6*b* begins to communicate with the second annular restriction portion 21*b* of the actuator port B. The area of the portion of the groove 80*b* which communicates with the restriction portion 21*b* increases with the stroke. The load pressure inside the actuator port B is introduced into the load-sensing port LS through the second passage hole 6*b* and the first guide holes 11. Since the restriction portion 100 is in communication with the load-sensing port LS as mentioned above, the laod pressure is admitted into the first passage hole 6*a* from the guide holes 10 while the flow rate is being restricted. This opens the load check valve 9*a*, and then the fluid escapes into the tank port Ta from the low-pressure hole 8*b*. Consequently, the load pressure inside the load-sensing port LS increases gradually.

After flowing into the load-sensing port LS, the load pressure passes into the first entrance to the shuttle valve 15. In this valve 15, this pressure is compared with the load pressure acting into the second entrance from the other direction selector valve to select the greatest load pressure. When only one direction selector valve is operated, the load pressure from the actuator for this selector valve is, of course, the greatest load pressure. In any case, the greatest load pressure is sent to the back pressure chamber in the unloading pressure control valve 14. If the resultant of this greatest load pressure and the load applied by the spring 140 overcomes the pressure delivered from the pump, then the valve body of the unloading pressure control valve is moved to close the valve. This reduces the amount of the pump delivery oil returned to the tank. The oil delivered by the pump is forced into the pump port P of the direction selector valve V. That is, the pump line pressure starts to be increased.

If the stroke of the spool 3 increases further, the high-pressure hole 7*b* contained in the second passage hole 6*b* begins to communicate with the first annular restriction port 20*b* of the bridge port PB. The pump pressure oil which has been stopped by the bridge port PB begins to be supplied into the actuator port B. This is the final stage of the control over the stroke provided by the restriction portion 100. FIG. 3 shows this condition. FIG. 4 shows the condition in which the spool 3 is at full stroke.

In the condition of FIG. 3, the oil forced out of the pump enters the second passage hole 6*b* via the bridge port PB and the high-pressure hole 7*b*, thus opening the load check valve 9*b*. Then, the oil flows into the actuator port B through the low-pressure hole 8*b* and the ring-shaped groove 80*b*. The oil from the pump also flows toward the front end of the passage hole 6*b*. At this time, the first guide holes 11 are sufficiently connected with the load-sensing port LS. However, the restriction portion 100 is not yet closed off by the spool hole wall 201*a*.

After flowing into the load-sensing port LS from the first guide holes 11, the pressure oil enters the guide holes 10 from the ring-shaped groove 101 while the flow rate is being restricted by the restriction portion 100. The fluid passes into the first passage hole 6*a* and escapes into the tank port Ta. As the spool 3 moves, the restriction portion 100 overlaps with the load-sensing port LS to a lesser extent. Therefore, the flow rate of the fluid flowing into the first passage hole 6*a* decreases. In consequence, the pressure inside the load-sensing port LS increases gradually.

Because the pressure inside the load-sensing port LS acts on the shuttle valve 15, the selected greatest load pressure increases. Since this increased pressure is introduced into the back pressure chamber in the unloading pressure control valve 14, the valve body of this valve 14 is closed to a greater extent. This results in increases in the pump line pressure.

If the spool 3 moves to the left from the above-described position, the restriction portion 100 is closed off by the spool hole wall 201*a* with the movement of the spool 3. The flow rate of the oil escaping into the tank port Ta decreases gradually, reducing the pressure inside the first passage hole 6*a*. As a result, the load check valve 9*a* is once closed.

Figure 6:
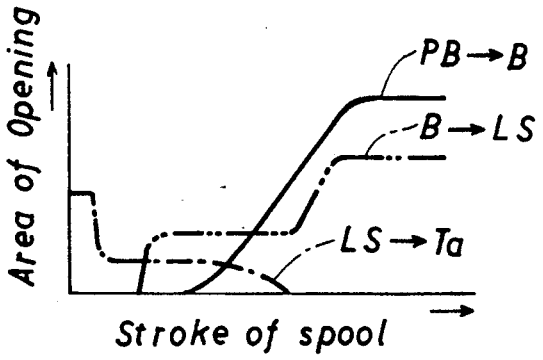
FIG. 6 is a graph showing the relation of the area of opening to the stroke in each line, obtained in accordance with the invention.

In the novel value, the area of the opening of one passage begins with LS and ends with Ta, while the area of the opening of the other passage begins with PB and ends with B as shown in FIG. 6. The former area of opening of the passage beginning with LS and ending with Ta is reduced down to zero because the restriction portion 100 is closed off by the spool hole wall 201*a*. Meanwhile, the pressure oil from the bridge port PB is kept supplied from the first guide holes 11 to the load-sensing port LS and from the high-pressure hole 8*b* to the bridge port B.

In the condition of FIG. 3, if the spool 3 approaches the end of the stroke, then the second guide holes 12 which were closed off by the spool hole wall 201*b* begin to communicate with the load-sensing port LS. The load pressure inside the actuator port B was guided into the load-sensing port LS only from the first guide holes 11. Now the load pressure is supplied from both first guide holes 11 and second guide holes 12 as shown in FIG. 4.

Therefore, as shown in FIG. 6, the area of the opening of the passage beginning with LS and ending with Ta becomes zero. At the same time, the area of the opening of the passage beginning with B and ending with LS increases linearly, thus increasing the pressure, or load pressure, inside the load-sensing port LS. This pressure inside the load-sensing port LS acts into the first entrance to the shuttle valve 15.

Either the load pressure from another actuator which is forced out of the exit of the shuttle valve 15 contained in another direction selector valve pictorially depicted in FIG. 1 or the previously selected high load pressure acts into the second entrance to the shuttle valve 15. The higher one of these load pressures is selected. In this example, the shuttle valve 15 is taken as the valve at the final stage for simplicity of illustration. In this way, the shuttle valve 15 selects the greatest load pressure out of the load pressures produced by the plural actuators. The greatest load pressure is sent to the back pressure chamber in the unloading pressure control valve 14 through an exit passage 150. The greatest load pressure admitted into the back pressure chamber is higher than the greatest load pressure at the previously described stage. Hence the valve body of the unloading pressure control valve is closed until the resultant of this greatest load pressure and the load applied by the spring 140 is balanced by the pressure, or pilot pressure, delivered from the pump. As such, the oil delivered from the pump forms the pump line pressure corresponding to the load pressure and is sent to each direction selector valve.

Figure 7:
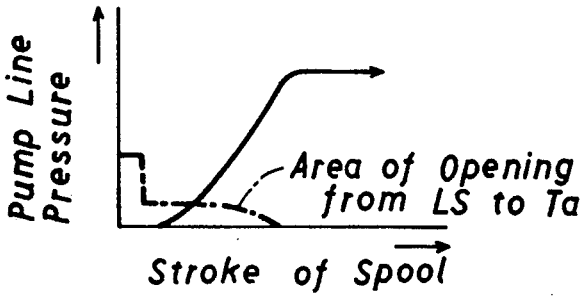
FIG. 7 is a graph showing the relation of the pump line pressure to the stroke, obtained in accordance with the invention.
Figure 8:
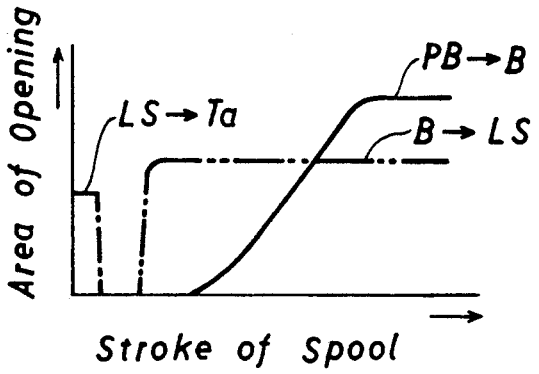
Fig. 8 (PRIOR ART)
FIG. 8 is a graph showing the relation of the area of opening to the stroke, obtained by the prior art direction selector valve.
Figure 9:
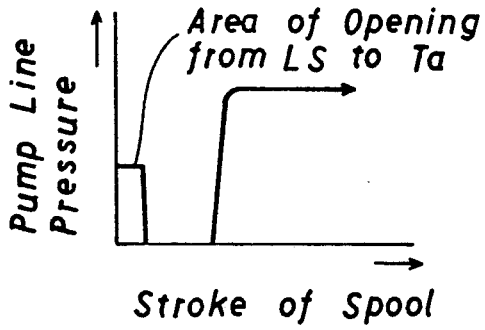
Fig. 9 (PRIOR ART)
FIG. 9 is a graph showing the relation of the pump line pressure to the stroke, obtained by the prior art direction selector valve.

The manner in which the load pressure inside each actuator is detected affects greatly the pump line pressure. In accordance with the present invention, as can be seen from FIGS. 3 and 6, at the initial stage of the stroke of the spool, the load pressure and the pressure oil from the bridge port PB escape from the load-sensing port LS into the tank port Ta while controlled by the restriction portion 100. Since the restriction portion 100 is gradually closed, the pressure inside the load-sensing port LS increases gradually. Accordingly, the greatest load pressure which is continuously selected by the shuttle valve and directed to the unloading pressure control valve 14 does not change suddenly but increases gradually. The valve body of the unloading pressure control valve closes slowly and smoothly. For this reason, the pump line pressure can be increased at a relatively mild rate as shown in FIG. 7. This mildly increased pump line pressure of oil is supplied to the bridge port PB via the pump port P and the notch 52 in the pressure-compensating valve 5 and then into the actuator port B. Consequently, the pressure applied to the actuator is controlled very well, especially at the beginning of the operation.

The tilt angle at which the pump line pressure increases as shown in FIG. 7 can be adjusted at will by adjusting the length of the restriction portion 100 adjacent to the ring-shaped grooves 101 in the guide holes 10. Moreover, the actuator port pressure is prevented from escaping if the restriction portion 100 covers a considerable portion of the stroke, insomuch as the load check valves 9*a* and 9*b* are installed in the passage holes 6*a* and 6*b*.

Subsequently, the load pressure in the actuator acts into the load-sensing port LS from the actuator port B. The difference between the load pressure in the actuator and the pressure inside the bridge ports PA, PB moves the cylindrical spool 5*a* of the pressure-compensating valve 5. The flow rate of the pressure oil flowing into the bridge ports PA and PB is controlled by the notch 52.

In accordance with the present invention, the two passage holes 6*a* and 6*b* of the spool 3 are used not only as the passages for detecting the load but also as the passages permitting the pressure oil from the pump to flow from the bridge ports PA, PB into the actuator ports A, B. In particular, when the spool 3 shifts to the left, the oil forced out of the pump flows from the bridge port PB into the right actuator port B through the high-pressure hole 7*b*, the second passage hole 6*b*, and the low-pressure hole 8*b*. At this time, the pressure inside the left actuator port A passes into the second passage hole 6*a* to thereby open the load check valve 9*a*, since the high-pressure hole 7*a* is put in communication with the actuator port A by the shift of the spool 3. Then, the pressure escapes into the tank port Ta. In this state, the guide holes 10 and the restriction portion 100 are closed by the spool hole wall 200*a* and so the pressure inside the left actuator port A does not flow into the load-sensing port LS.

When the pressure oil from the pump is supplied into the left actuator port A, the spool 3 is moved to the right. Thus, the pressure oil is forced out of the bridge port PA into the left actuator port A through the high-pressure hole 7*a*, the first passage hole 6*a*, and the low-pressure hole 8*a*. At this time, the first guide holes 11 act to restrict the flow rate, for detecting the load pressure in the same way as the above-described restriction portion 100.

The flow rate of the fluid flowing into the actuator ports A and B is controlled by the high-pressure holes 7*a* and 7*b* formed radially of the spool without using any notch whose depth and inclination are required to be machined with high accuracy. Therefore, the machining operation is easy to perform. Furthermore, the accuracy can be enhanced.

If sufficient flow rate is not obtained only from the internal passages, notches are formed in the land portions 30*a* and 30*b* of the spool. The oil forced out of the pump is directed into the actuator ports A and B via the passage holes 6*a* and 6*b*. When the spool 3 has moved from its neutral position, the notches are made operative. The oil is forced into the actuator ports A and B via these notches. In this case, it is necessary that a load check valve for opening and closing the hole 51 be incorporated in the cylindrical spool 5*a* of the pressure-compensating valve 5.

What is claimed is:

1. A direction selector valve having function of detecting the load pressure inside an actuator, said direction selector valve comprising:

a valve body (1) having a spool hole (2);

a spool (3) slidably inserted in the spool hole (2);

a load-sensing port (LS) formed around the center of the spool hole (2);

bridge ports (PA, PB) formed on opposite sides of the load-sensing port (LS) around the spool hole (2);

actuator ports (A, B) formed on opposite sides of the load-sensing port (LS) around the spool hole (2);

tank ports (Ta, Tb) formed on opposite sides of the load-sensing port (LS) around the spool hole (2);

a first dead-end passage hole (6*a*) and a second dead-end passage hole (6*b*) extending axially partially through the spool (3) from its both side ends;

high-pressure holes (7*a*, 7*b*) which are formed in the first and second passage holes (6*a*, 6*b*), respectively, and which, when the spool (3) is in its neutral position, is closed off by spool hole walls existing between the bridge ports and their respective actuator ports;

low-pressure holes (8*a*, 8*b*) which are formed in the first and second passage holes (6*a*, 6*b*), respectively, and which, when the spool (3) is in its neutral position, are placed in communication with the tank ports (Ta, Tb), respectively;

load check valves (9*a*, 9*b*) mounted in the first and second passage holes (6*a*, 6*b*), respectively, and acting to open and close the low-pressure holes (8*a*, 8*b*), respectively;

guide holes (10) which are formed near the front end of the first passage hole (6*a*) and which, when the spool (3) is in its neutral position, are placed in communication with the load-sensing port (LS);

a restriction portion (100) formed on the outer surface of the spool (3) adjacently to the guide holes (10) to control the flow rate of the oil from the load-sensing port (LS) to one tank port (Ta) at the initial stage of the movement of the spool;

first guide holes (11) and second guide holes (12) formed near the front end of the second passage hole (6*b*) in a close relation to each other, the first guide holes (11) being so located that they are in communication with the load-sensing port (LS) even when the spool (3) is in its neutral position, the second guide holes (12) being so located that when the spool (3) is in its neutral position, they are closed by a spool hole wall (201*b*) and that they are placed in communication with the load-sensing port (LS) after the spool has shifted from its neutral position, connecting the high-pressure hole (7*b*) with the bridge port (PB).

2. The direction selector valve of claim 1, wherein said high-pressure holes (7*a*, 7*b*) extend radially from the first and second passage holes (6*a*, 6*b*), respectively, and wherein the holes of each kind of the high-pressure holes (7*a*, 7*b*) are located on the same circumference.

3. The direction selector valve of claim 1, wherein (a) the guide holes (10) extend radially from the first passage hole (6*a*) and are located on the same circumference;

(b) the guide holes (10) are in communication with a ring-shaped groove (101) formed in the outer surface of the spool;

(c) the restriction portion (100) comprises at least two notches whose ends are in communication with the ring-shaped groove (101).

4. The direction selector valve of claim 1, wherein said restriction portion (100) begins to operate after the low-pressure hole (8*b*) contained in the second passage hole (6*b*) is disconnected from the pump port (Ta), and wherein this operation of the restriction portion continues after the low-pressure hole (8*b*) has been connected with the actuator port (B) and even when the high-pressure hole (7*b*) is placed in communication with the bridge port (PB).

5. The direction selector valve of claim 1, wherein first annular restriction portions (20*a*, 20*b*) are formed in relatively outer locations in the bridge ports (PA, PB) and cooperate with the high-pressure holes (7*a*, 7*b*) to form restricting passages when the spool has moved from its neutral position.

6. The direction selector valve of claim 1, wherein the diameter of the guide holes (10) is larger than that of the first guide holes (11).

7. The direction selector valve of claim 1, wherein ring-shaped grooves (80*a*, 80*b*) are formed in the outer surface of the spool and wherein (a) the low-pressure holes (8*a*, 8*b*) are in communication with the ring-shaped grooves (80*a*, 80*b*), respectively, formed in the outer surface of the spool;

(b) first annular restriction portions (21*a*, 21*b*) are formed at relatively outer positions in the actuator ports (A, B), respectively;

(c) second annular restriction portions (22*a*, 22*b*) are formed at relatively inner positions in the tank ports (Ta, Tb), respectively; and (d) the ring-shaped grooves (80*a*, 80*b*) are placed in communication with the second annular restriction portions (22*a*, 22*b*), respectively, when the spool (3) is in its neutral position.

8. The direction selector valve of claim 1, wherein the rear ends of the first and second passage holes (6*a*, 6*b*) are closed off by plugs (3*a*, 3*b*), respectively, and wherein the load check valves (9*a*, 9*b*) have poppet valve bodies (91), respectively, which are biased by springs (92) supported by plugs (3*a*, 3*b*), respectively, whereby the front ends of the poppet valve bodies (91) are seated on seat portions (90) at the boundaries between the low-pressure holes (8*a*, 8*b*) and their respective passage holes (6*a*, 6*b*).

9. The direction selector valve of claim 1, wherein the first guide holes (11) extend radially from the second passage hole (6*b*), and wherein the second guide holes (12) extend radially from the second passage hole (6*b*).

10. The direction selector valve of claim 1, wherein said direction selector valve includes a shuttle valve (15, 16), a pump and an unloading pressure control valve (14) which adjusts the pressure delivered from said pump, depending on the greatest load pressure produced by actuators and also on the load applied by a spring (140), said unloading pressure control valve having a back pressure chamber, and wherein (a) the load-sensing port (LS) is in communication with a vertical hole (4) extending perpendicular to the spool hole (2);

(b) a pressure-compensating valve (5) is disposed in this vertical hole (4);

(c) the pressure-receiving surface of the pressure-compensating valve (5) is in communication with the load-sensing port (LS) which, in turn, is in communication with an entrance to the shuttle valve;

(d) the exit of the shuttle valve is adapted to communicate with the back pressure chamber in said unloading pressure control valve (14).

11. The direction selector valve of claim 10, wherein the exit of the shuttle valve is adapted to communicate directly with the back pressure chamber.

12. The direction selector valve of claim 10, wherein the exit of the shuttle valve is adapted to communicate via another shuttle valve (15, 16) with the back pressure chamber.

* * * * *